US009834851B2

(12) United States Patent
Lai

(10) Patent No.: US 9,834,851 B2
(45) Date of Patent: Dec. 5, 2017

(54) METHOD OF ANODIC TREATMENT FOR A METAL WORKPIECE COMBINED WITH A NON-METALLIC MATERIAL

(71) Applicant: CATCHER TECHNOLOGY CO., LTD., Tainan (TW)

(72) Inventor: Feng-Ju Lai, Taipei (TW)

(73) Assignee: CATCHER TECHNOLOGY CO., LTD., Tainan (TW)

( * ) Notice: Subject to any disclaimer, the term of this patent is extended or adjusted under 35 U.S.C. 154(b) by 174 days.

(21) Appl. No.: 15/041,296

(22) Filed: Feb. 11, 2016

(65) Prior Publication Data

US 2017/0081774 A1 Mar. 23, 2017

(30) Foreign Application Priority Data

Sep. 23, 2015 (TW) ..... 104131404 A

(51) Int. Cl.

| | |
|---|---|
| ***C25D 11/18*** | (2006.01) |
| ***C25D 11/02*** | (2006.01) |
| ***C25D 11/24*** | (2006.01) |
| ***C25D 11/10*** | (2006.01) |
| ***C25D 11/08*** | (2006.01) |
| ***C25D 11/16*** | (2006.01) |
| *C23G 1/02* | (2006.01) |
| *C23F 3/03* | (2006.01) |
| *C23G 1/14* | (2006.01) |

(52) U.S. Cl.

CPC ..... *C25D 11/10* (2013.01); *C25D 11/08* (2013.01); *C25D 11/16* (2013.01); *C25D 11/18* (2013.01); *C25D 11/243* (2013.01); *C25D 11/246* (2013.01); *C23F 3/03* (2013.01); *C23G 1/02* (2013.01); *C23G 1/14* (2013.01)

(58) Field of Classification Search

CPC ..... C25D 11/18
USPC ..... 205/229
See application file for complete search history.

(56) References Cited

U.S. PATENT DOCUMENTS

| | | | | |
|---|---|---|---|---|
| 4,518,468 A * | 5/1985 | Fotland | ..... | C25D 11/18 205/201 |
| 2003/0001274 A1* | 1/2003 | Den | ..... | B82Y 10/00 257/761 |
| 2013/0292256 A1* | 11/2013 | Hu | ..... | C25D 11/16 205/211 |

FOREIGN PATENT DOCUMENTS

| | | |
|---|---|---|
| CN | 102616070 A | 8/2012 |
| TW | 201346072 A | 11/2013 |

* cited by examiner

*Primary Examiner* — Brian W Cohen
(74) *Attorney, Agent, or Firm* — Li & Cai Intellectual Property (USA) Office

(57) ABSTRACT

A method of anodic treatment for a metal workpiece combined with a non-metallic material includes steps as follows. A pretreatment process is applied to the metal workpiece. The metal workpiece is anodic oxidized, and washed with water. Then, the metal workpiece is put in a vacuum environment to evaporate a residual chemical agent between a metal part and a plastic part of the metal workpiece. The metal workpiece is washed with water. An activating treatment is applied to the metal workpiece. The metal workpiece is dyed, and is sealed.

8 Claims, 2 Drawing Sheets

METHOD OF ANODIC TREATMENT FOR A METAL WORKPIECE COMBINED WITH A NON-METALLIC MATERIAL

BACKGROUND OF THE INSTANT DISCLOSURE

1. Field of the Instant Disclosure

The instant disclosure relates to a method of anodic treatment for a metal workpiece combined with a non-metallic material; in particular, to a method of metal surface treatment technology to form a colorful appearance on the metal workpiece.

2. Description of Related Art

Following the progress of metalworking technology, more and more portable electronic products such as mobile phones or notebooks are equipped with a metal shell. However, the metal shell will affect the transmission and reception of wireless signals, which results in bad reception of signal.

To improve the problem of bad reception, a technology has been developed to integrally combine a metal part and a plastic part. Thus, the wireless signal can be transmitted through the plastic part for improving a better wireless signal communication.

Concerning the above mentioned art, after the metal shell, which combines a metal part with a plastic part, is processed with anodic treatment, a gap between the metal part and the plastic part easily happens to create uneven spots of different colors. Thus, the defect-free rate of the product's appearance is lower. To clean the above mentioned spots, one way is to process with pickling by nitric acid, surface conditioning agent, and water washing, so as to remove the residual acid agent in the gaps between the metal part and the plastic part. However, if the number of cleanings or the time is not controlled well during cleaning the metal shell, it easily results in environmental failure testing of the metal shell, such as, thermal cycling testing, salt spray testing, sweat testing . . . etc.

To address the above issues, the inventors strive via industrial experience and academic research to present the instant disclosure, which can effectively improve the limitations described above.

SUMMARY OF THE INSTANT DISCLOSURE

The object of the instant disclosure is to provide a method of anodic treatment for a metal workpiece combined with a non-metallic material, to reduce abnormal-color spots from happening on the metal workpiece after anodic treatment, so as to increase the defect-free rate of the metal workpiece.

In order to achieve the aforementioned objects, according to an embodiment of the instant disclosure, a method of anodic treatment for a metal workpiece combined with a non-metallic material includes the steps as follows:

pretreating the metal workpiece;

anodic oxidizing the metal workpiece;

water washing the metal workpiece;

disposing the metal workpiece in a vacuum environment, so as to evaporate a residual chemical agent remaining between a metal part and the non-metallic material of the metal workpiece;

water washing the metal workpiece;

activating the metal workpiece;

dyeing the metal workpiece; and sealing the metal workpiece.

Based on the above, the instant disclosure has the following advantages. The instant disclosure provides a method of arranging the metal workpiece in a vacuum environment, to lower down the evaporating temperature of the residual chemical agent, so that the chemical agent remaining in the gaps between the metal part and the non-metallic material (such as plastic part) of the metal workpiece can be evaporated at room temperature. Thus, it achieves the effect of cleaning the residual chemical agent, and reduces the influence of the chemical agent on the surface of the metal workpiece, to increase the defect-free rate of the metal workpiece.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

[First Embodiment]

Figure 1:
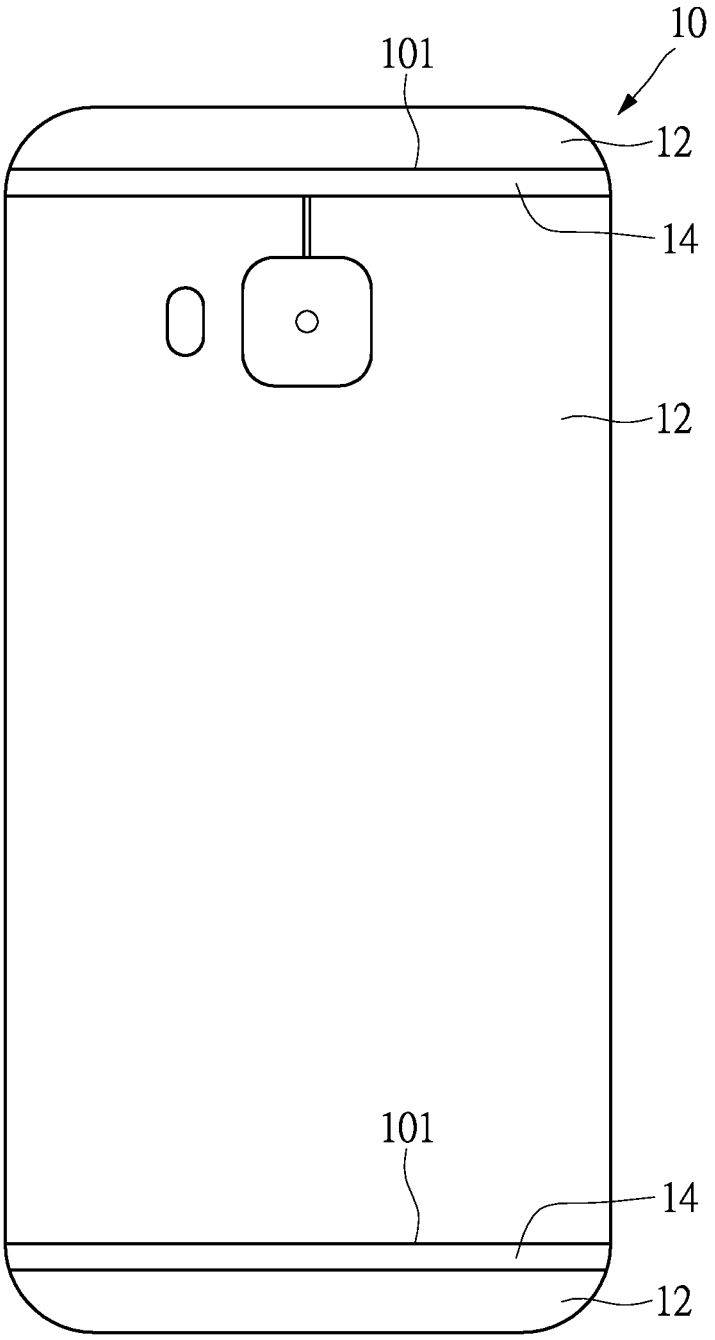
FIG. 1 shows a front view of metal workpiece combined with a non-metallic material in accordance to the instant disclosure.
Figure 2:
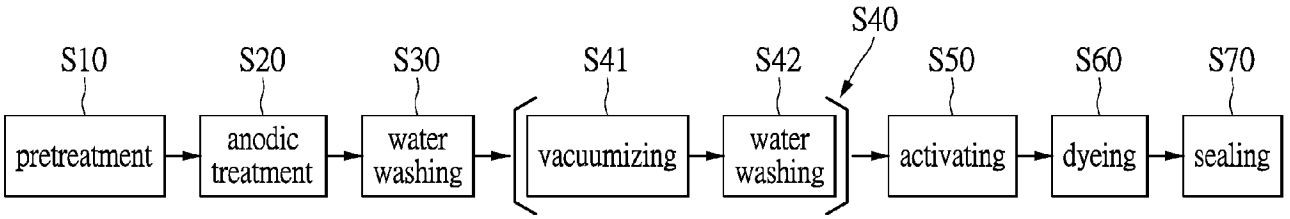
FIG. 2 shows a flowchart of anodic treatment for a metal workpiece combined with a non-metallic material in accordance to the instant disclosure.

Please refer to FIG. 1 and FIG. 2 which respectively shows a front view and a flowchart of anodic treatment for a metal workpiece combined with a non-metallic material in accordance to the instant disclosure.

This instant disclosure provides a method of anodic treatment for a metal workpiece 10 combined with a non-metallic material, so to avoid abnormal spots to happen in gaps 101 between a metal part 12 and a non-metallic material, such as a plastic part 14 in this embodiment, on the metal workpiece 10. To combine a non-metallic material in the metal workpiece 10, it can utilize a "Plastic Clad on Metal" technology. An engineering plastic, such as Polyphenylene Sulfide (PPS), Polybutylene Terephthalate (PBT), or Polyamide, (PA), is directly combined in the metal workpiece 10 by injection molding. The anodic treatment in this instant disclosure includes steps of pretreatment to dyeing, and finally sealing, to complete all steps.

Please refer to FIG. 2. According to the instant disclosure, the method of anodic treatment for a metal workpiece combined with a non-metallic material includes steps as follows.

First, step S10 is pretreatment, to pretreat the metal workpiece 10.

Step S20 is anodic oxidation, anodic oxidizing the metal workpiece 10.

Step S30 is water washing, to wash the metal workpiece 10.

Step S40 is a process to remove the residual chemical agent by disposing the metal workpiece 10 in a vacuum environment. The step S40 includes a step S41 of vacuum creation, and a step S42 of water washing In step S41, the metal workpiece 10 is disposed in a vacuum environment, so as to evaporate the residual chemical agent between the metal part and plastic part of the metal workpiece, and then, in step S42, the metal workpiece is water washed. The principle of step S41 is mainly to lower the atmospheric pressure, so as to lower down the evaporating temperature of the residual chemical agent (for example, Sulfuric acid, or Oxalic acid) during the step S20 of anodic oxidation. Thus, the residual chemical agent can be evaporated out of the gap 101 between the metal part 12 and the plastic part 14. And then, to process the step S42 of water washing, for washing the chemical agent evaporated out.

Step S50 is an activating treatment, to activate a surface of the metal workpiece 10, which is of benefit to the following surface treatment, such as to enhance the dyeing effect.

Step S60 is dyeing, to dye the metal workpiece 10.

Finally, step S70 is sealing, to seal the metal workpiece. The above steps are introduced in detail in the following paragraphs.

Concerning the step S10 of pretreating the metal workpiece 10, the object is to clean and prepare the metal workpiece 10 to be fit for anodic treatment. The pretreatment step can include sub-processes, such as degreasing, alkaline etching, pickling, chemical polishing, water washing and drying . . . etc. The pretreatment step differs according to the quality requirements of the metal workpiece 10, which decides the kind and numbers of sub-process. Some sub-process with related parameters are illustrated in following paragraphs.

The degreasing sub-process can be used to clean the oil stains remaining on the surface of the metal workpiece 10 after the mechanical process. To clean the oil stains, the metal workpiece 10 can be soaked in a degreasing solution. After each degreasing sub-process, at least one water washing is implemented. The sub-process of water washing can be implemented one to five times, and a preferred practice is two times to clean the residual chemical agent or stains after the former sub-process.

The alkaline etching sub-process is not necessary, but is according to the requirements of the metal workpiece 10. The parameters of alkaline etching, in general, are that the metal workpiece 10 is soaked in an alkaline solution of 50~500 g/L, 10~90 degrees Celsius. For example, a solution of Sodium hydroxide (NaOH) of 220 g/L and about 25 degrees Celsius. The unit of temperature in this instant disclosure is degrees Celsius.

The pickling sub-process is not necessary, but is according to the requirements of the metal workpiece 10. The parameters of pickling, in general, are that the metal workpiece 10 is soaked in a pickling solution of 50~500 g/L and 10~90 degrees Celsius. A practical embodiment could be hydrogen nitrate ($HNO_3$) of 5 ml/L and about 25 degrees Celsius.

The parameters of chemical polishing sub-process, in general, are that it can be implemented in an acid solution of 1%~85% volume percent, at 10~90 degrees Celsius. A practical embodiment could be orthophosphoric acid ($H_3PO_4$) at 90~93 degrees Celsius.

Concerning step S20 of anodic treatment, the parameters are different according to the color required to appear on the metal workpiece 10. The anodic treatment is to dispose the metal workpiece 10 in an electrolytic tank and connected to the anode, and the cathode is connected to a carbon board or a lead board. Then, a predetermined voltage and current is applied. The metal workpiece 10 is anode oxidized, so as to form a oxidized film on the surface of the metal workpiece 10. For example, the parameters are as follows. The solution can be sulphuric acid ($H_2SO_4$), Oxalic acid ($H_2C_2O_4$), orthophosphoric acid ($H_3PO_4$), boric acid ($H_3BO_3$), tartaric acid ($C_4H_6O_6$) in 1~95% volume percent, in 5~50 degrees Celsius, current density 0.2~3.0 A/dm$^2$ for a period of 10~60 minutes.

One practical embodiment of anodic treatment is to soak the metal workpiece 10 in a sulphuric acid solution of 15% to 25% volume percent, at 15~25 degrees Celsius, 8~16 Volts, current density 0.8~2.0 A/dm$^2$, for a period of time at least 45 minutes. A preferred time is at least 30 minutes. After the anodic treatment, at least one step S30 of water washing is implemented.

Concerning the step S40 of removing the residual chemical agent, in step S41 of vacuum creation, the metal workpiece 10 is disposed in a vacuum environment so as to evaporate the residual chemical agent between the metal part and the plastic part of the metal workpiece 10. In this embodiment, the metal workpiece 10 is disposed in an enclosed space, and the enclosed space is vacuumized, so that the residual chemical agent can be evaporated at room temperature. Thus, the residual chemical agent between the metal part 12 and the plastic part 14 of the metal workpiece 10 can be removed. Then, the metal workpiece 10 is moved outside the enclosed space. In this embodiment, the vacuum pressure of the enclosed space can be 1~100 (Torr, equal to 1/760 atm (Standard Atmospheric Pressure Unit), about 1 mmHg or 1.333 mbar). In addition, the temperature of the enclosed space preferably can be increased to 50 degrees Celsius.

The instant disclosure utilizes the vacuum method to evaporate the residual chemical agent on the surface of the metal workpiece 10 or in the gap 101. Under the condition of vacuum pressure of 1~100 Torr, the boiling point of water, or sulfuric acid in 20% volume percent, is lower than 20 degrees Celsius. Therefore, it has a cleaning effect of removing the acid solution. Moreover, the using a vacuum has less influence on the anodizing film than chemical cleaning.

However, the instant disclosure is not limited in the above mentioned parameters. The same function can also be achieved if the metal workpiece 10 is disposed at a temperature under the molten point of the combined non-metallic material, and in a medium vacuum of $25\sim1\times10^{-3}$ Torr, or in a rough vacuum of 25~760 Torr, so as to evaporate the residual chemical agent.

A supplementary note, the instant disclosure can be applied to a metal workpiece 10 with different thickness, and the gap 101 between the metal part 12 and the plastic part 14 can have various depths. The step S40 of removing the residual chemical agent can be implemented repeatedly, so as to remove the residual chemical agent more thoroughly.

Concerning the step S50 of activating the metal workpiece 10, the objective is to enhance the dyeing effect on the surface of the metal workpiece 10 after anodic treatment. The activating agent can fully activate the surface of the metal workpiece to benefit the following surface treatments. The method of activating can use an acid solution of 1-50 ml/L, at a temperature 5-95 degrees Celsius, for a period of 5-90 minutes. Then, implementing the step of water washing 1-5 times. A preferred embodiment of this embodiment is that, the metal workpiece 10 can be soaked in a hydrogen nitrate solution of 20 ml/L, at about 25 degrees Celsius. Then, two times of water washing at 25 degrees Celsius are implemented. The function of activating is to remove the silica fumes or impurity on the metal workpiece 10 after anodic treatment, so as to enhance the dyeing quality.

After the activating step, the step S60 of dyeing is used to dye the surface of the metal workpiece 10. For example, it can use general commercial aluminum alloy dyestuff, at 5-50 degrees Celsius for a period of 0.1-10 minutes. A preferred embodiment is 40 degrees Celsius for a period of 1-6 minutes. After that, a step of two times of water washing at about 25 degrees Celsius is implemented.

To enhance the antifouling property and anti-corrosive property of the anodizing film, a step S70 of sealing is processed in the instant disclosure, so as to seal the micropores on the surface of the metal workpiece 10 by the sealing agent. The sealing process after the anodic treatment can use a commercial Nickel acetate sealing agent. The sealing agent in this instant disclosure is commercial Nickel acetate sealing agent of 1-15 g/L, at 5-95 degrees Celsius for a period of 5-90 minutes. The commercial Nickel acetate sealing agent means a sealing agent of Nickel acetate based sealer.

A preferred embodiment of the parameters of the sealing process is to soak the metal workpiece 10 in the commercial Nickel acetate sealing agent of 7 g/L, in 90±5 degree Celsius for a period of 30 minutes.

[Second Embodiment]

Figure 3:
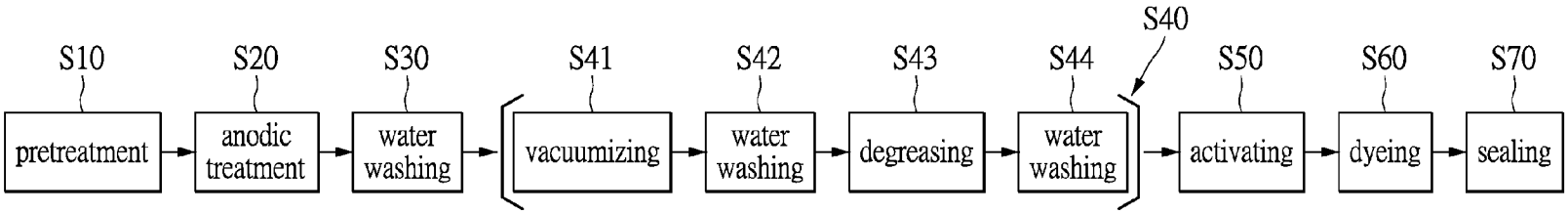
FIG. 3 shows a flowchart of anodic treatment for a metal workpiece combined with a non-metallic material of another embodiment in accordance to the instant disclosure.

Refer to FIG. 3, which is a process flowchart of another embodiment of anodic treatment for a metal workpiece combined with a non-metallic material according to the preferred embodiment. Different from the first embodiment, the step S40 of removing the residual chemical agent in this embodiment further includes a step S43 of degreasing. A practical parameter of degreasing can use a degreasing agent of 1-50% volume percent, at 10-90 degrees Celsius. The solution concentration of degreasing agent is decided according the usage condition of the metal workpiece 10. For example, for a metal shell of an electronic product in this embodiment, a preferred parameter is to use a degreasing agent of 3-5% volume percent, in about 50 degrees Celsius.

After the degreasing step, following is step S44 of water washing to wash the residual degreasing agent. The water washing step can be processed for one to five times, at 5-95 degrees Celsius. A preferred temperature is about 25 degrees Celsius, for two times.

The instant disclosure has the characteristics and functions that, by the vacuumizing manner, the chemical agent remaining in the gaps between the metal part and the non-metallic material (for example, plastic part) of the metal workpiece 10 can be evaporated. Thus, it achieves the cleaning effect of removing the residual chemical agent. In addition, the vacuumizing way is better than the treating method using a chemical agent. The vacuumizing way has less influence on the anodizing film on the metal workpiece, so as to increase the defect-free rate of the metal workpiece. Therefore, the successful rate of environmental failure testing, such as thermal cycling testing, salt spray testing, and sweat testing, in the instant disclosure can be increased. Not only are the defect products reduced, but also the products from failure testing are reduced.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A method of anodic treatment for a metal workpiece combined with a non-metallic material, comprising the following steps of:

pretreating the metal workpiece;

anodic oxidizing the metal workpiece;

water washing the metal workpiece;

disposing the metal workpiece in a vacuum environment, so as to evaporate a chemical agent remaining between a metal part and the non-metallic material of the metal workpiece;

water washing the metal workpiece;

repeating the steps of disposing the metal workpiece in the vacuum environment and water washing the metal workpiece thereafter; and then activating the metal workpiece;

dyeing the metal workpiece; and sealing the metal workpiece.

2. The method of anodic treatment for a metal workpiece combined with a non-metallic material according to claim 1, wherein the pretreatment step includes at least one of the steps as follows: degreasing, alkaline etching, pickling, water washing, and drying.

3. The method of anodic treatment for a metal workpiece combined with a non-metallic material according to claim 1, wherein the step of disposing the metal workpiece in the vacuum environment includes steps as follows:

disposing the metal workpiece in an enclosed space;

vacuumizing the enclosed space so as to remove the chemical agent remaining between the metal part and the non-metallic material of the metal workpiece; and moving the metal workpiece out from the enclosed space.

4. The method of anodic treatment for a metal workpiece combined with a non-metallic material according to claim 3, wherein a pressure of the enclosed space is vacuumized to 1 to 100 Torr.

5. The method of anodic treatment for a metal workpiece combined with a non-metallic material according to claim 4, wherein the temperature in the enclosed space is further increased to 50 degrees Celsius.

6. The method of anodic treatment for a metal workpiece combined with a non-metallic material according to claim 3, wherein the temperature in the enclosed space is increased but lower than a melting point of the non-metallic material.

7. The method of anodic treatment for a metal workpiece combined with a non-metallic material according to claim 1, further comprising a step of degreasing the metal workpiece, before the step of activating the metal workpiece.

8. The method of anodic treatment for a metal workpiece combined with a non-metallic material according to claim 7, further repeating the steps of disposing the metal workpiece in the vacuum environment, water washing the metal workpiece and degreasing the metal workpiece; and then processing the step of activating the metal workpiece.

* * * * *